US007640906B2

(12) United States Patent
Sailer et al.

(10) Patent No.: US 7,640,906 B2
(45) Date of Patent: Jan. 5, 2010

(54) HYDRAULIC VALVE LASH ADJUSTER WITH IDLE STROKE FUNCTION FOR A VALVE TRAIN OF AN INTERNAL COMBUSTION ENGINE

(75) Inventors: Peter Sailer, Erlangen (DE); Oliver Schnell, Veitsbronn (DE); Christian Schäfer, Nürnberg (DE); Andreas Hempfling, Igensdorf (DE)

(73) Assignee: Schaeffler KG, Herzogenaurach (DE)

( * ) Notice: Subject to any disclaimer, the term of this patent is extended or adjusted under 35 U.S.C. 154(b) by 174 days.

(21) Appl. No.: 11/904,693

(22) Filed: Sep. 28, 2007

(65) Prior Publication Data

US 2008/0087244 A1 Apr. 17, 2008

(30) Foreign Application Priority Data

Oct. 13, 2006 (DE) ..... 10 2006 048 549

(51) Int. Cl.
*F01L 1/20* (2006.01)

(52) U.S. Cl. ..... 123/90.46; 123/90.52; 123/90.43; 123/90.16

(58) Field of Classification Search ..... 123/90.16, 123/90.52, 90.55, 90.43, 90.46
See application file for complete search history.

(56) References Cited

U.S. PATENT DOCUMENTS

2005/0229887 A1* 10/2005 Sailer et al. ..... 123/90.55

FOREIGN PATENT DOCUMENTS

DE 697 07 731 T2 2/1997
DE 10 2004 018 457 A1 4/2004
DE 10 2004 035 588 A1 7/2004
DE 10 2005 010 711 A1 3/2005
EP 1 568 852 A1 8/2005

* cited by examiner

*Primary Examiner*—Zelalem Eshete
(74) *Attorney, Agent, or Firm*—Charles A. Muserlian

(57) ABSTRACT

A hydraulic valve lash adjuster with idle stroke function for a valve train of an internal combustion engine, said hydraulic valve lash adjuster comprising a piston (2, 2', 2") that is guided for displacement in a piston housing (4) and elastically supported against said housing (4), said piston (2, 2', 2") comprising a low pressure chamber (3) that communicates via an axial opening (7) in a piston bottom (8) with a high pressure chamber (5) defined by the piston housing (4) and the piston (2, 2', 2"), and further comprising a control valve (9, 9', 9", 9'") acting between said pressure chambers (3, 5), said control valve (9, 9', 9", 9'") comprising a valve closing body (10, 10', 10") that can be brought to bear sealingly against a valve seat (15, 15') that surrounds the axial opening (7) on a piston body undersurface (18) and is received in an element (12, 12') that limits a closing body stroke (17), and said control valve (9, 9', 9", 9'") further comprising a control valve spring (11) that loads the valve closing body (10, 10', 10") with a spring force in opening direction, and an idle stroke being produced during a collapsing movement between the piston (2, 2', 2") and the piston housing (4) during which said valve closing body (10, 10', 10") is hydraulically loaded in closing direction against the action of the control valve spring (11) by a pressure build-up in the high pressure chamber (5), whereby a retarded pressure build-up can be obtained through a flow control device (23, 23') arranged on a high pressure chamber-side and comprising a flow control element (24, 24') and a medium pressure chamber (19) that extends between the flow control element (24, 24') and the axial opening (7) of the piston (2).

18 Claims, 9 Drawing Sheets

HYDRAULIC VALVE LASH ADJUSTER WITH IDLE STROKE FUNCTION FOR A VALVE TRAIN OF AN INTERNAL COMBUSTION ENGINE

FIELD OF THE INVENTION

The invention concerns a hydraulic valve lash adjuster with idle stroke function for a valve train of an internal combustion engine, for example, for an automotive vehicle, said hydraulic valve lash adjuster comprising a piston that is guided for displacement in a piston housing and elastically supported against said housing, said piston comprising a low pressure chamber that communicates via an axial opening in a piston bottom with a high pressure chamber defined by the piston housing and the piston, and further comprising a control valve acting between said pressure chambers, said control valve comprising a valve closing body that can be brought to bear sealingly against a valve seat that surrounds the axial opening on a piston body undersurface and is received in an element that limits a closing body stroke, and said control valve further comprising a control valve spring that loads the valve closing body in opening direction, and an idle stroke being produced during a collapsing movement between the piston and the piston housing during which said valve closing body is hydraulically loaded in closing direction against the action of the control valve spring by a pressure build-up in the high pressure chamber.

BACKGROUND OF THE INVENTION

Hydraulic valve lash adjusters are used in valve trains of internal combustion engines in automotive vehicles to adjust a valve lash that results from thermal expansion, manufacturing tolerances and wear of the transmitting elements during a loading of a gas exchange valve by a cam. For this purpose, in the case of common lash adjusters, the respective mechanical transmitting element that transmits a cam lift of the cam to the gas exchange valve comprises a piston that is guided with sealing clearance for displacement in a housing and is elastically supported against the housing by a piston spring, so that a tensioning of the piston spring prevents any lash formation on the gas exchange valve.

The force transmission to the gas exchange valve via the lash adjuster during cam loading is regulated by a control valve that controls a flow of a hydraulic medium through an axial opening between a low pressure chamber of the piston serving as an oil reservoir and a high pressure chamber that is enclosed by the piston and the housing. The control valve includes a closing body, mostly a control valve ball that is arranged on a piston undersurface in the high pressure chamber, and a control valve spring that applies a spring force to the control valve ball. A fundamental distinction is made in this field between two types of constructions.

In a standard construction, the control valve spring is arranged as a closing operative element that presses the control valve ball with a biasing force against a valve seat on the axial opening configured as a piston bore on the piston bottom undersurface. Accordingly, the control valve of the lash adjuster is closed during a cam base circle phase when the cam of a rotating camshaft runs on the associated valve train member. During a subsequent displacement of the piston by a cam lobe, a corresponding adjusting stroke is transmitted with an adjusting force directly via the lash adjuster to the gas exchange valve that is directly actuated in opening direction. Because the oil in the high pressure chamber is incompressible, the lash adjuster then acts as a "rigid" adjusting member.

It is only upon the subsequent expansion of the piston and housing relative to each other through the piston spring, when the cam re-reaches the base circle and the pressure in the high pressure chamber sinks, that the control valve opens against the force of the control valve spring and a pressure equalization takes place between the pressure chambers till the control valve spring closes the control valve again.

Because in this type of construction, especially during a commencing warming-up phase of the still cold engine, a so-called pumping-up of the lash adjuster via the control valve can take place, even to the extent of a negative valve lash that leads to high engine loading accompanied by increased wear, an alternative construction with an opening control valve spring has already been proposed.

Hydraulic valve lash adjusters of this type with an opening control valve spring are known as Reverse Spring Hydraulic Valve Lash Adjusters (referred to hereinafter as "RSHVA") or Normally Open Lash Adjusters (NOLA), for example from EP 1 298 287 A2 and WO 2006 010 413 A1. In such constructions, the control valve spring is reverse-arranged, generally within the piston bore between the reservoir and the high pressure chamber, so that the control valve ball or the closing body is loaded in opening direction and the control valve is consequently open in the cam base circle phase. In this arrangement, the control valve ball is usually received in a closing body cap that is retained on the piston bottom undersurface. The closing body cap comprises openings that serve as an oil passage and a bottom for limiting the stroke of the control valve ball.

In the case of an RSHVA, a cam excursion at first causes a control oil stream to flow from the high pressure chamber to the low pressure chamber, i. e. in closing direction, as a result of which the lash adjuster collapses in axial direction, so that the piston and the housing are pushed together. The control oil flows around the control valve ball which, as a result, is then loaded both hydrostatically and hydrodynamically against the action of the control valve spring till a resultant axial force presses the control valve ball against the valve seat and the control valve closes. The collapsing movement of such an RSHVA manifests itself in a characteristic idle stroke before the actuation, properly speaking, of the gas exchange valve takes place. RSHVAs therefore act as "soft" adjusting elements that exclude a negative valve lash.

The idle stroke of the RSHVAs has an influence on the valve lift of the gas exchange valves and on the valve timing in the internal combustion engine. A corresponding idle stroke characteristic, that is speed-dependent due to the volume flow between the pressure chambers that varies with the cam speed, can be purposefully used in a valve or camshaft control for improving thermodynamic efficiency, for reducing pollutant emission and improving the quality of the idle stroke of the internal combustion engine as described, for example, in the not pre-published documents DE 10 2005 043 947.0 and DE 10 2005 054 115.1 of the applicant.

However, the closing time of the control valve and thus the idle stroke of RSHVAs may be subject to relatively large fluctuations. Tests have shown that a relatively high degree of dependence of the closing behavior of the control valve on the oil viscosity exists practically over the entire temperature range of the engine oil (−25° to +160° C.). Further important factors that influence the operation of an RSHVA include the flow geometry that is determined by the configuration of the individual control valve components, the closing displacement of the control valve closing body as also manufacturing and material tolerances. An important target in the further development of RSHVAs is therefore the minimization of these disturbing functional fluctuations and of the parameterdependence. Different proposals for improvement have already been made in this connection.

In the RSHVA known from WO 2006 010 413 A1, temperature-sensitive means, for example, bimetal elements or memory metal elements, are arranged in the low pressure chamber or in the axial opening. With sinking temperature, these elements increasingly vary the oil stream flowing from the high pressure chamber to the low pressure chamber, so that a control valve closing time that is not sensitive to the temperature of the control oil or engine oil and, thus also, a great degree of equalization of the idle stroke at different operating temperatures can be obtained. Functional fluctuations from one temperature-sensitive element to another due to manufacturing tolerances and the relatively complex flow geometry that make an exact pre-determination of the hydrodynamics and hydrostatics of the control valve are hardly taken into account in this document.

The document 10 2004 018 457 A1 shows an RSHVA with different closing body geometries and guide aids for guiding the respective closing body in a correspondingly configured closing body cap. In particular, the valve closing body can be configured with a needle-shape, the needle being formed by a ball prolonged by a circular cylindrical intermediate member. The guide aids configured, for example, as guide surfaces surround the closing body with a guide clearance, so that the valve closing body is moved linearly during the closing operation, quasi in the manner of a piston.

The main concern of this document is to propose an RSHVA in which undesired eccentric dislocations and rotary movements caused in particular by unguided hydrodynamic loading can be prevented by a guided, predominantly hydrostatic axial loading of the valve closing body. This active closing body guidance eliminates operational fluctuations due to undesired closing body movements. Accordingly, the prior art RSHVA presents an improved service performance in this respect that is also less susceptible to fluctuation.

On the whole, the prior art publications on the improvement and further development of RSHVAs essentially concern the dependence of the closing behavior of the control valve, and thus of the idle stroke resulting therefrom, on flow geometry, temperature, speed and manufacturing tolerances. This has already made some improvements in this type of RSHVAs possible.

It would be further desirable to make available to the user, an RSHVA with an idle stroke that is matched to the particular application and/or the dimensions of the components of the RSHVA. An application-specific and/or construction-adapted idle stroke, in particular, in combination with the use of the speed-dependence, with a simultaneous reduction of the functional fluctuations, could lead to a further improvement of the efficiency and the advantages of RSHVAs and enlarge their scope of use. The prior are, however, contains no explicit suggestions in this regard.

OBJECTS OF THE INVENTION

It is an object of the invention to provide an RSHVA with an idle stroke of adjustable size that at the same time guarantees a high reliability and operational safety.

This and other objects and advantages of the invention will become obvious from the following detailed description.

SUMMARY OF THE INVENTION

The invention is based on the appreciation of the fact that through the installation of flow-sensitive means in the high pressure chamber that exert a controlled influence on the pressure build-up during the closing movement of the control valve, an RSHVA can be set in advance, so that a defined, desired idle stroke is obtained upon loading by a cam.

The starting point of the invention is therefore a hydraulic valve lash adjuster with idle stroke function for a valve train of an internal combustion engine, for example, for an automotive vehicle, said hydraulic valve lash adjuster comprising a piston that is guided for displacement in a piston housing and elastically supported against said housing, said piston comprising a low pressure chamber that communicates via an axial opening in a piston bottom with a high pressure chamber defined by the piston housing and the piston, and further comprising a control valve acting between said pressure chambers, said control valve comprising a valve closing body that can be brought to bear sealingly against a valve seat that surrounds the axial opening on a piston body undersurface and is received in an element that limits a closing body stroke, and said control valve further comprising a control valve spring that loads the valve closing body in opening direction, and an idle stroke being produced during an axial collapsing movement between the piston and the piston housing during which said valve closing body is hydraulically loaded in closing direction against the action of the control valve spring by a pressure build-up in the high pressure chamber.

According to a further provision of the invention a retarded pressure build-up can be obtained through a flow control device arranged on a high pressure chamber-side and comprising a flow control element and a medium pressure chamber that extends generally between the flow control element and the axial opening.

Through this arrangement, a medium pressure valve switching of the RSHVA control valve is realized. The essential element of the arrangement is a flow control element that retards the build-up of high pressure by at first establishing a region of medium pressure above the flow control element. This means that a medium pressure chamber that influences the closing time of the control valve is purposefully arranged in the pressure differential between the high pressure chamber and the low pressure chamber being formed on the closing body during the axial collapsing movement of the adjuster.

The closing time of the control valve depends essentially on a volume that flows during a collapsing movement of the adjuster from the high pressure chamber into the low pressure chamber and subjects the closing body to hydrodynamic and hydrostatic loading. At a given collapsing speed v that is produced by the excursion speed of a loading cam $V_N$, an effective flow cross-section A that depends on the flow geometry, in particular, on the cross-section of the adjuster, is determinative for the volume flow dV/dt. The inventive flow control element constitutes, in operative connection with the medium pressure chamber, an important element for adjusting this flow cross-section A so that a determined idle stroke can be obtained. This advantageously permits the setting of different idle strokes for different uses, or in the reverse case, for matching the idle strokes of adjusters with different piston diameters or different flow geometries.

A particularly simple flow control device can be realized by the arrangement of the medium pressure chamber in a stepped recess on the undersurface of the piston bottom and a flow control element that is configured as a disk comprising apertures and is fixed on the piston bottom undersurface. This flow control disk can be fixed on the piston bottom undersurface through a cap flange of a conventional closing body cap in which the closing body is received.

Basically, the flow control disk can be made of any solid material, for example sheet steel. Other materials, for instance plastics or ceramics that offer weight advantages and/or have a low thermal expansion, can also be of advantage. The flow control disk separates the high pressure chamber from the medium pressure chamber that is situated above it with the result that when the pressure rises during the collapsing movement of the adjuster, pressure build-up takes place at first under the flow control disk, and the control disk retards the pressure build-up in the medium pressure chamber that is connected to the low pressure chamber through the axial opening.

The degree of retardation can be controlled particularly effectively with the help of apertures arranged in the flow control disk. These apertures can be configured as simple bores which reduce the oil flow to a greater or lesser extent, depending on their number and diameter as also on their throat geometry. However, other aperture geometries or apertures with latch-type or disk spring-type flaps or other active transfer elements may also be used that open to a greater or lesser extent as a function of a momentary back pressure and/or as a function of their temperature, so that a still finer medium pressure switching can be set.

Further possibilities of adjusting the idle stroke can be realized by a defined positioning of the apertures of the flow control element relative to the usual oil passages of the closing body cap or by a mutual adaptation of the mentioned configurations of the apertures, the spring force of the control valve spring and the stroke of the closing body. All of these variations can be used separately or in combination for achieving an idle stroke adjustment complying as exactly as possible to the specification and, at the same time, reducing undesired functional fluctuations to the largest possible extent.

For the functioning of the flow control device, the cooperation with the valve closing body must be taken into consideration. During its hydraulic loading, the closing body must be able to lift slightly off the cap bottom or its stroke limitation and must be able to come to bear reliably against the valve seat. On the other hand, at least at the beginning of pressure build-up, an adequate separation must be guaranteed between the medium pressure chamber and the high pressure chamber in order to effect the targeted pressure build-up retardation in the direction of the axial opening.

A particularly effective separation of the medium pressure chamber and the high pressure chamber that does not impede the stroke movement of the closing body can be advantageously achieved if the flow control disk comprises a central bore in which the valve closing body is guided with guiding clearance. The guidance additionally prevents lateral dislocations of the closing body that can have an undesired effect on the closing time.

The valve closing body may be configured as a needle-shaped sealing piston with a plate-like sealing surface. Such an elongate valve closing body will be guided over its entire stroke by the flow control disk with the guiding clearance, so that hardly any oil flows between the outer periphery of the closing body and the edge of the central bore into the medium pressure region. The hydraulic loading of such a valve needle is more of a hydrostatic nature than of a hydrodynamic nature and therefore comparatively easier to determine.

By submerging the control valve spring in a central recess of the sealing piston, with the spring being supported between an edge of the axial opening of the RSHVA piston and a bottom of the recess, a particularly compact accommodation and an improved fixation of the spring can be achieved. Further, the influence of the control valve spring on the flow geometry as compared to a support of the spring directly in the medium pressure chamber between the plate surface of the valve body and the edge of the axial opening, can be reduced by the fact that approximately half the length of the spring is sunk into the central recess of the sealing piston and the other half into the axial opening, the spring being supported between a step of the axial opening and the bottom of the recess of the closing body.

The inventive flow control device can also be used advantageously with conventional control valve balls as closing bodies. In this case, in contrast to the valve needle, the central bore in the flow control element opens at the moment the ball starts to move towards the valve seat at the proper flow speed of the oil, so that, after a comparatively short time in the medium pressure region, the high pressure range becomes active.

According to a further proposition of the invention, the flow control element may also be configured as a pot comprising apertures. The valve closing body is then received in this pot that serves, at the same time, in an analogous manner to the closing body cap, as a stroke limitation. A conventional closing body cap can thus be omitted, so that no additional component is required for the realization of the flow control device, which brings the advantages of economy, lighter weight and simpler assembly. The apertures for adjusting the idle stroke can be arranged in the region of a flange of the pot. The pot bottom serves, in a known manner, as a stroke limitation for the adjusting stroke of the valve closing body.

Analogous to the closing body cap, the flow control pot can be fixed through the pot flange to the undersurface of the piston bottom, for instance by joining, pressing, gluing, clamping or with additional securing elements. The medium pressure region is formed substantially above the pot flange.

The pot bottom may have a central bore, but for functioning as a stroke limitation, the diameter of this bore must be smaller than that of the valve closing body. If the valve closing body is a ball, analogously to the central bore of a flow control disk, the central bore of the pot must open at least partially as soon as the ball lifts off the pot bottom, so that a comparatively rapid switching-over of the medium pressure valve switching function to the high pressure range is obtained.

The invention is described in the following with reference to the appended drawing that illustrates some examples of embodiment of the invention.

DETAILED DESCRIPTION OF THE DRAWINGS

Figure 1:
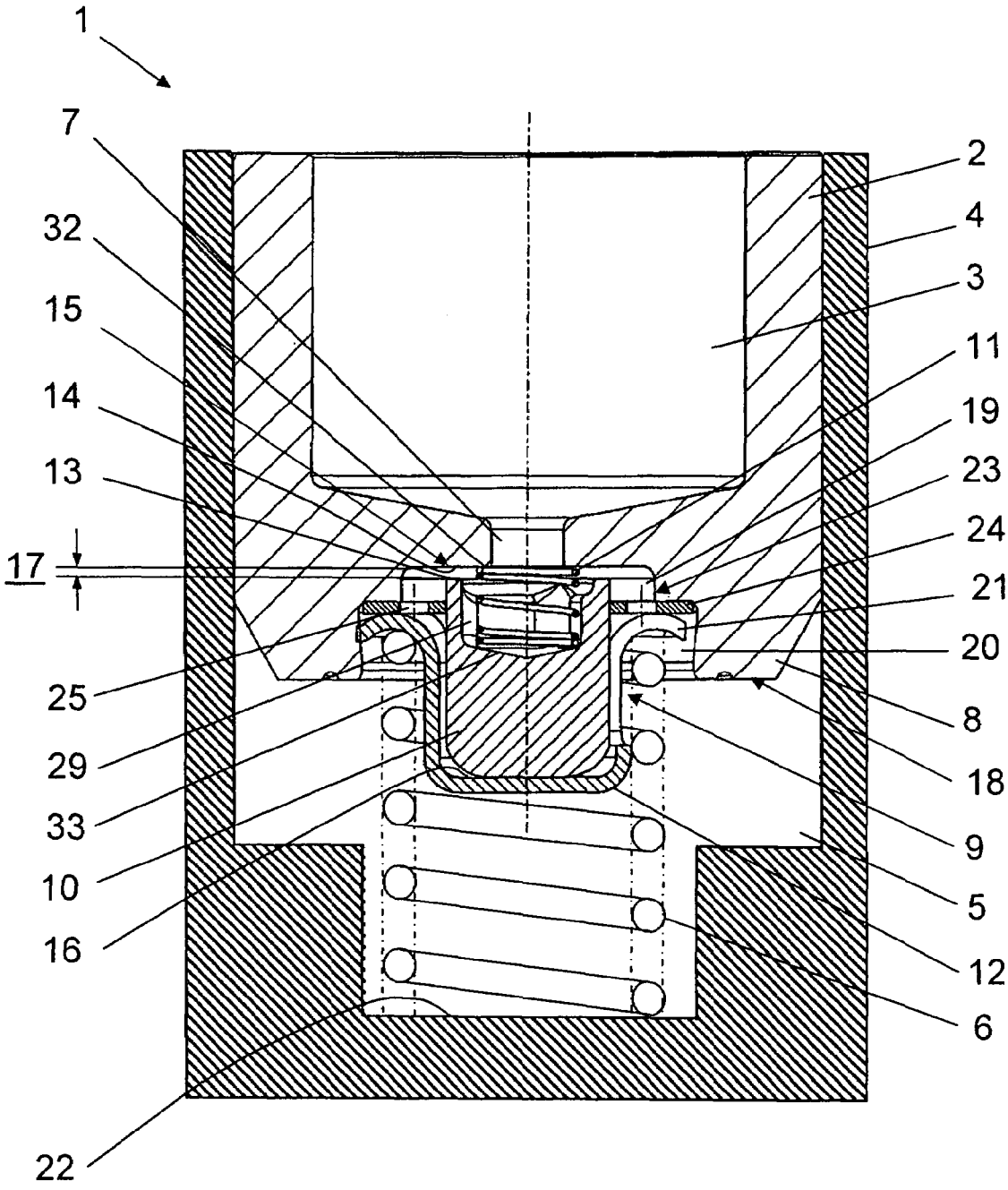
FIG. 1, shows a portion of an RSHVA comprising a flow control device, in a longitudinal section, in an open position of the control valve, FIG. 1*a*, a piston of the RSHVA of FIG. 1, as a detail, FIG. 1*b*, a disk-shaped flow control element of the RSHVA of FIG. 1, as an enlarged detail, FIG. 1*c*, a closing body cap of the RSHVA of FIG. 1, as an enlarged detail, FIG. 1*d*, a needle-shaped valve closing body of the RSHVA of FIG. 1, as an enlarged detail, FIG. 2, a second form of embodiment of the RSHVA in a longitudinal section in an open position of the control valve, with a modified valve spring mounting, FIG. 2*a*, a piston of the RSHVA of FIG. 2, as a detail, FIG. 2*b*, a needle-shaped valve closing body of the RSHVA of FIG. 2, as an enlarged detail, FIG. 3, a third form of embodiment of the RSHVA in a longitudinal section in an open position of the control valve, with a ball-shaped valve closing body, FIG. 3*a*, the form of embodiment of the RSHVA of FIG. 3 in a closed position of the control valve, FIG. 3*b*, a piston of the RSHVA of FIG. 3, as a detail, FIG. 3*c*, a closing body cap of the RSHVA of FIG. 3, and FIG. 4, a fourth form of embodiment of the RSHVA in a longitudinal section in an open position of the control valve, with a pot-like flow control element.

The RSHVA shown in FIG. 1 is advantageously configured as a hydraulic tappet 1 (roller tappet, cup tappet etc.) of a valve train of an internal combustion engine in an automotive vehicle. The structure and mode of functioning of such hydraulic valve lash adjusters having a control valve spring with an opening function are known, per se, particularly also from the aforesaid publications. By way of example, reference is made here to WO 2006 010 413 A1. According to the invention, the tappet 1 additionally comprises a flow control device 23.

In the tappet 1, a cylindrical piston 2 is guided with sealing clearance for axial displacement in a piston housing 4. A low pressure chamber 3 serving as an oil reservoir is configured within the piston 2 and can be supplied with control oil or engine oil through an oil supply, not illustrated. The piston 2 and the housing 4 define a high pressure chamber 5. For adjusting a valve lash, the axial length of the high pressure chamber 5 can be varied by a piston spring 6 that is configured as a coiled compression spring through which the piston 2 and the housing 4 are elastically supported on each other. Said pressure chambers 3 and 5 are connected through an axial opening 7 in the form of a piston bore in a piston bottom 8.

The piston bore 7 can be loaded by a control valve 9 that is arranged coaxially under the piston bore 7 on a piston bottom undersurface 18 of the piston bottom 8. The control valve 9 can be actuated through an alternating high pressure build-up and a pressure equalization between the pressure chambers 3 and 5 as a function of a cyclic cam loading of the tappet 1 during the routine operation of the valve train.

Figure 1A:
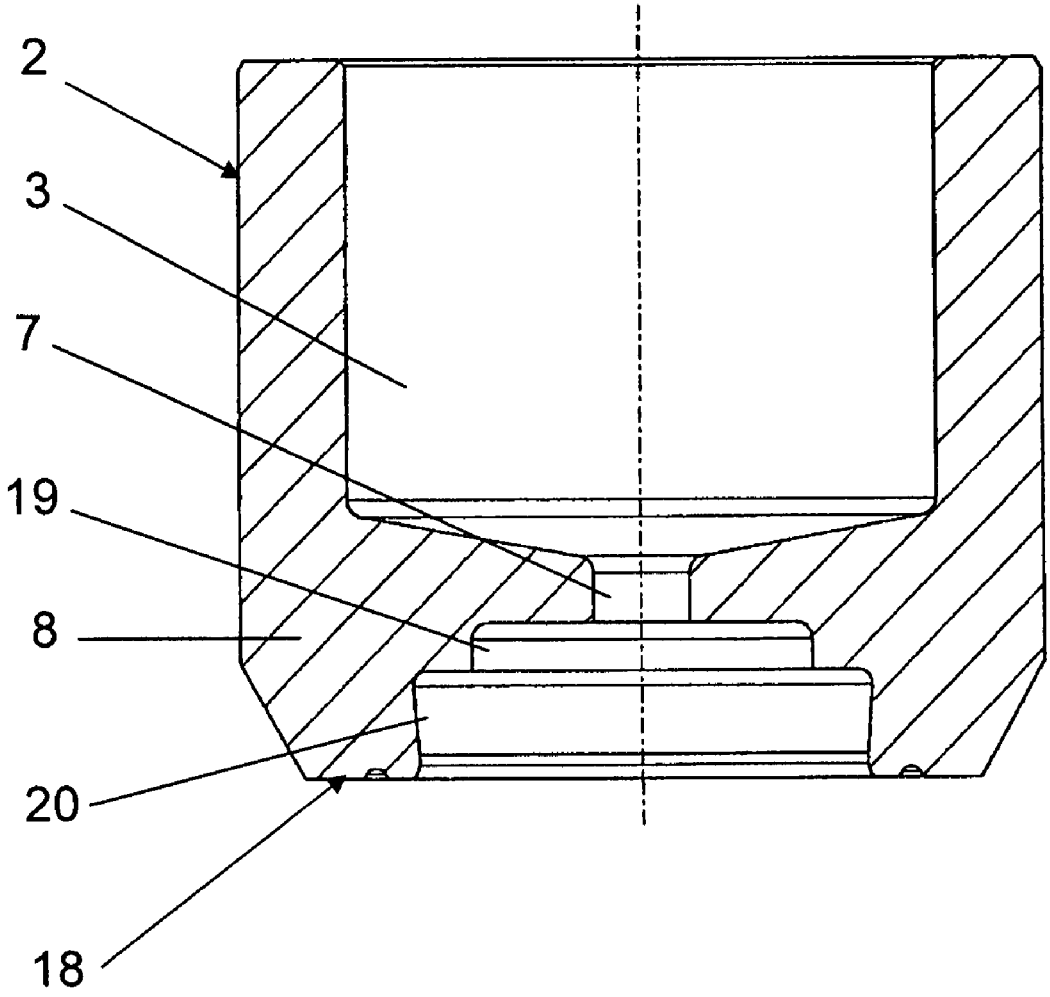
Figure 1B:
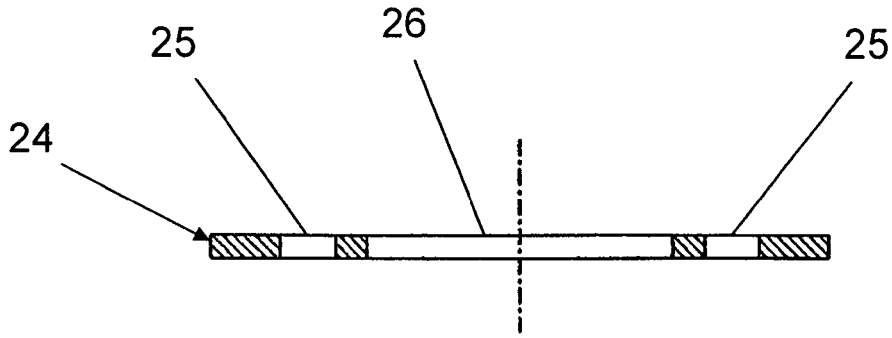
Figure 1C:
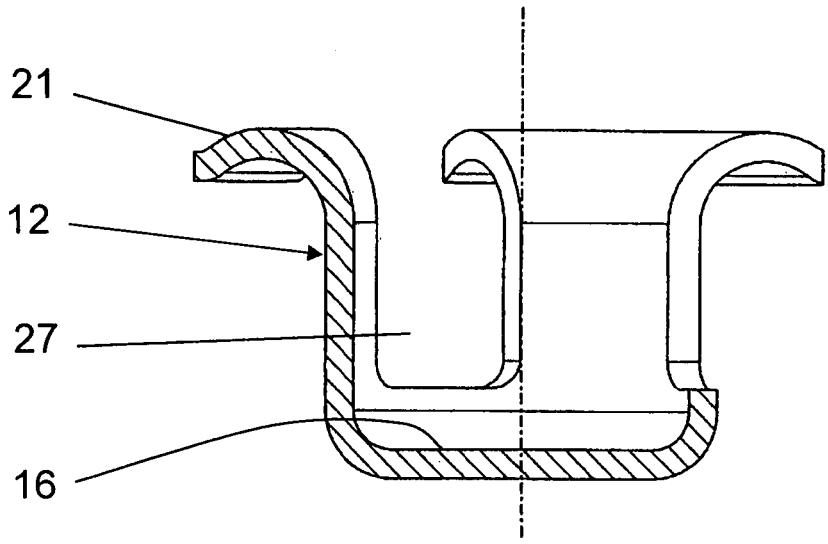
Figure 1D:
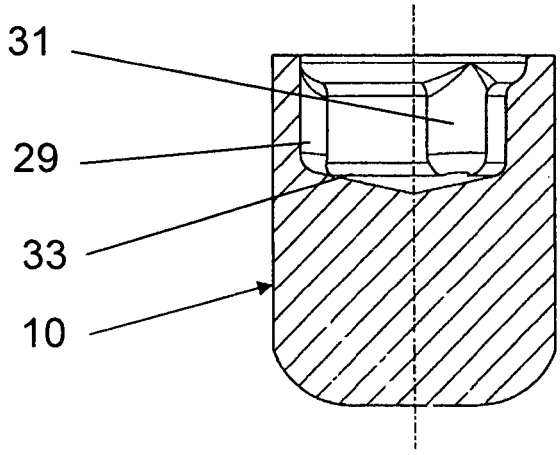

The control valve 9 comprises a valve closing body 10, illustrated separately in FIG. 1*d*, a control valve spring 11 configured as a coiled compression spring and a closing body cap 12 fixed on the piston bottom undersurface 18 and represented in FIG. 1*c* in which the closing body 10 is received and whose bottom 16 serves as a stroke limitation for the closing body 10. The construction and the fixing of such a closing body cap on a piston bottom are described, in particular, in the Applicant's DE 10 2004 018 386 A1.

The valve closing body 10 is advantageously configured as an elongate, cylindrical body, a so-called valve needle, with a plate-shaped sealing surface 13 that corresponds to a planar sealing surface 14 of a valve seat 15 surrounding the piston bore 7.

The control valve spring 11 is arranged partially submerged in a central recess 29 of the closing body 10 and is supported between a bottom 33 of the recess 29 and an edge 32 of the axial opening 7, so that in the open state of the valve shown in FIG. 1, the closing body 10 is pressed by a biasing spring force of the control valve spring 11 against the stroke-limiting bottom 16 of the closing body cap 12. In this way, an opening gap corresponding to a closing body stroke 17 is rendered free between the closing body 10 and the valve seat 15 and enables an oil flow between the pressure chambers 3 and 5. To enable a more effective transfer of control oil through the piston bore 7 via the coils of the control valve spring 11 in the open state of the control valve 9, the recess 29 in the closing body 10 may comprise an additional lateral protrusion 31, not specified further.

FIG. 1*a* shows the piston 2 of the RSHVA in a separate representation in which two cylindrical recesses 19 and 20 that are configured on the piston bottom undersurface 18 as a stepped continuation of the piston bore 7 can be seen, the diameter of the upper recess 19 being smaller than that of the lower bore 20 but larger than the diameter of the piston bore 7. The closing body cap 12 with its advantageously resilient configuration can be clipped with the help of a collar-like cap flange 21 configured on the closing body cap 12 into the lower recess 20 that is slightly tapered inwards. The piston spring 6 is supported between the cap flange 21 and a bottom 22 of the piston housing 4, so that the closing body cap 12 is additionally fixed on the piston bottom undersurface 18.

The upper, valve seat-proximate recess 19 functions as a medium pressure chamber and constitutes, according to the invention, in operative connection with a flow control element 24, the flow control device 23. The flow control element 24 shown in FIG. 1*b* is advantageously configured as a disk out of sheet steel. The flow control disk 24 comprises apertures 25 configured as bores. Further, a central bore 26 of the flow control disk 24 serves to receive the closing body 10 with a radial guide clearance.

The flow control disk 24 is fixed to the cap flange 21 on the step of the recess 19. It can also be fixed separately firmly to this step. Through the flow control disk 24, the recess 19 functions as a medium pressure chamber because, due to the apertures 25, the hydraulic pressure build-up is comparatively retarded. The degree of retardation can be determined by the size, geometry and number of bores 25 as also by their positioning relative to one or more recesses 27 of the closing body cap 12 already at the designing stage.

Figure 2:
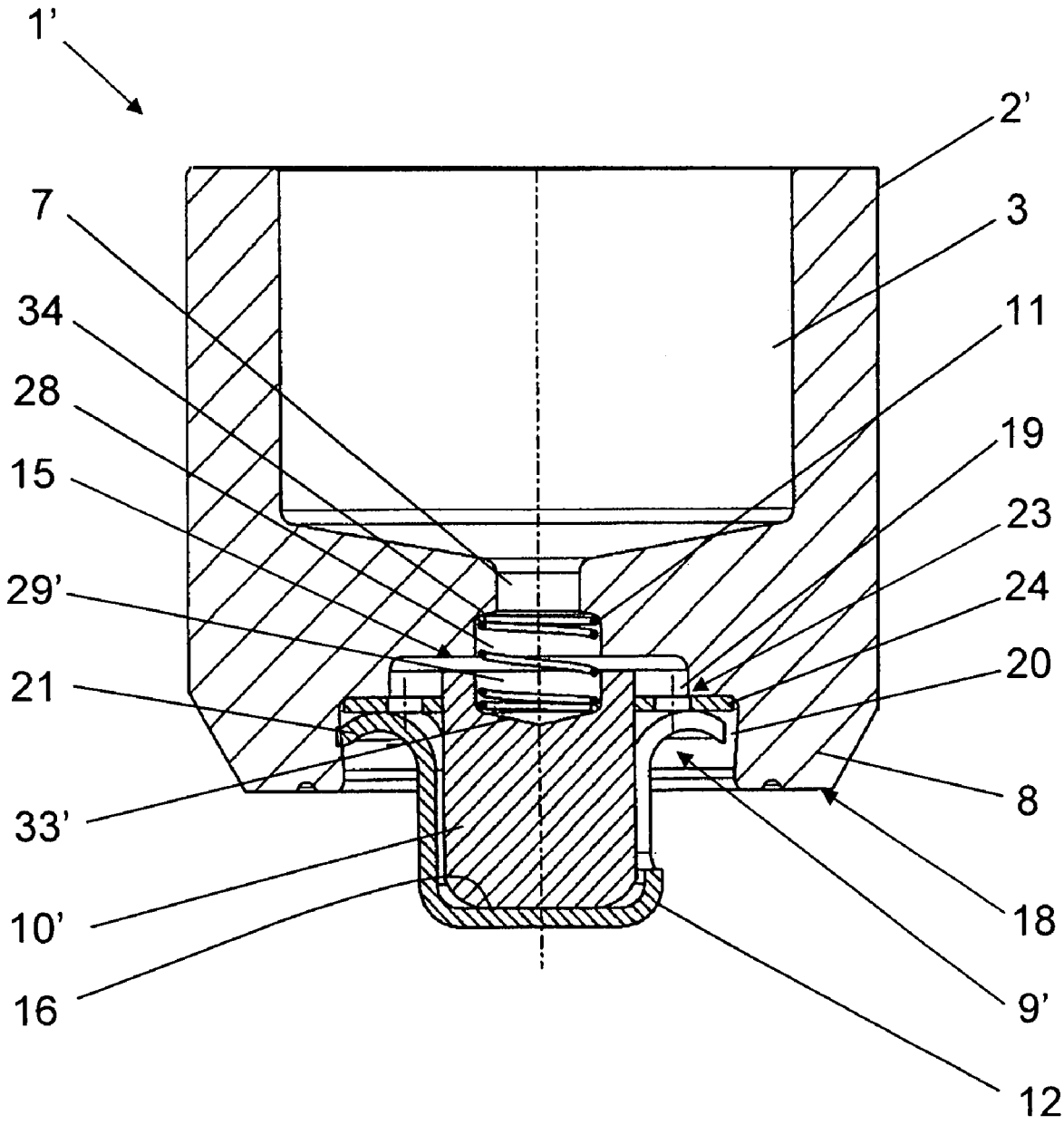
Figure 2A:
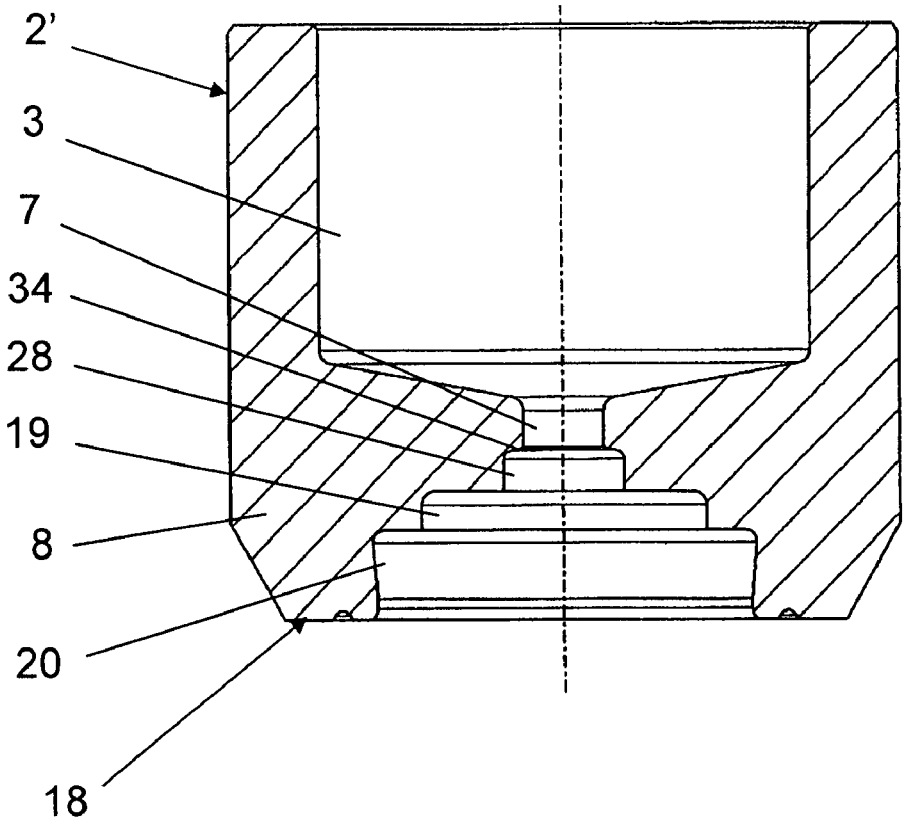
Figure 2B:
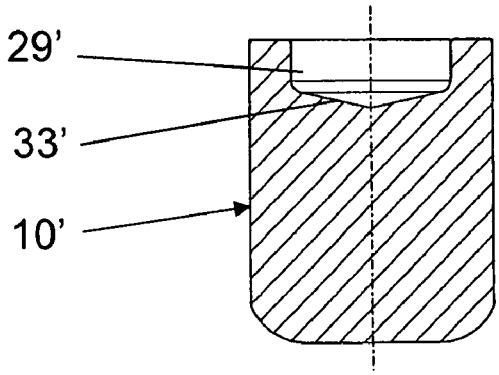

In a tappet 1' shown in FIG. 2, comprising a control valve 9", a stepped, cylindrical widening 28 of the axial opening 7 is configured in the piston bottom 8 of a piston 2' (FIG. 2*a*). The widening 28 corresponds to a recess 29' of a closing body 10' (FIG. 2*b*), the control valve spring 11 being submerged on both sides in these recesses 28 and 29' while being supported between an axial edge 34 of the widening 28 and a bottom 33' of the closing body recess 29'.

Figure 3:
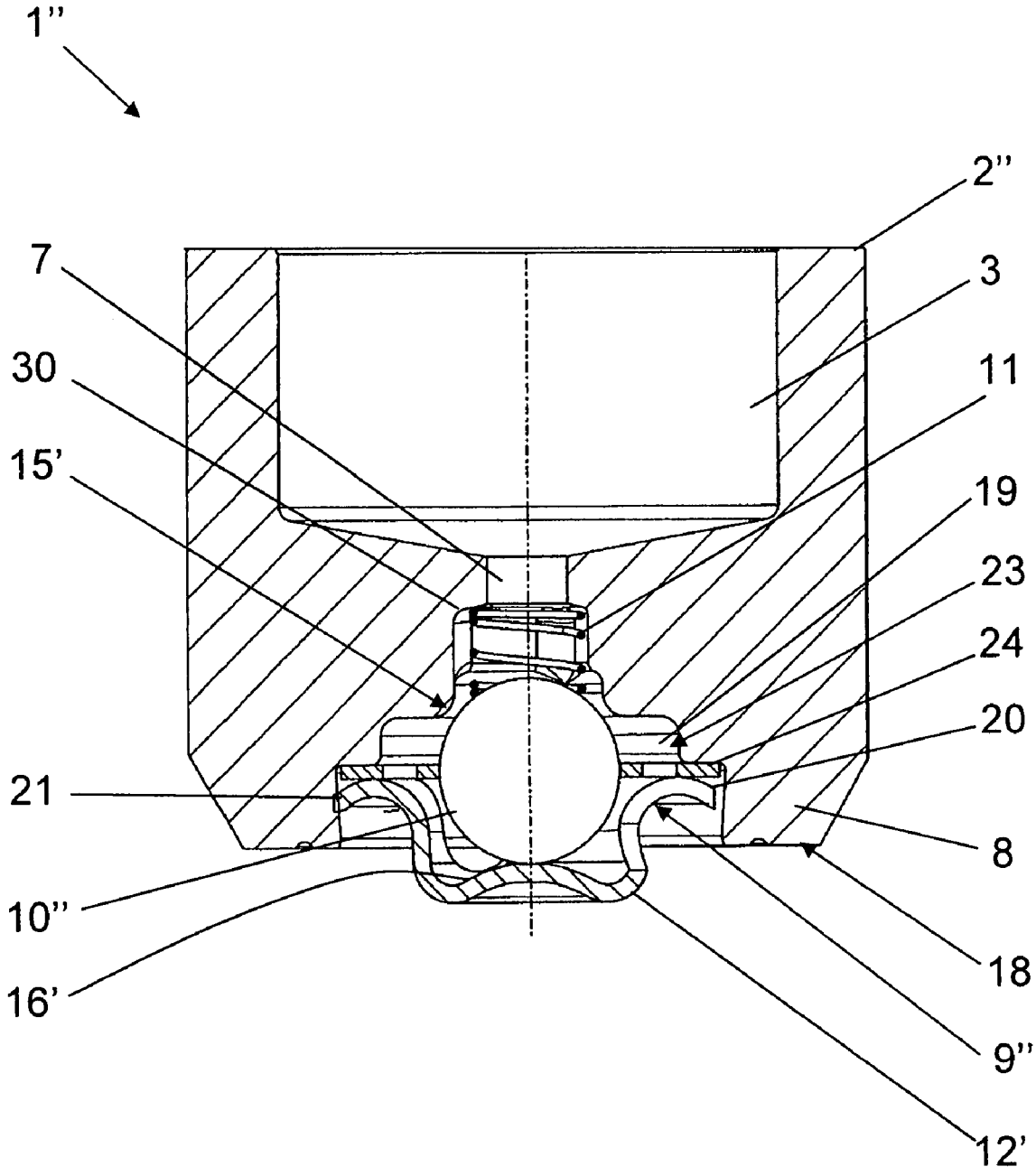

FIG. 3 shows a further form of embodiment of a tappet 1" comprising a control valve 9" and a piston 2" (FIG. 3*b*) in which, in place of the valve needle 10, 10', a control valve ball 10" constitutes the valve closing body. The control valve is shown in an open state in FIG. 3 and in a closed state in FIG. 3*a*. The control valve ball 10" corresponds to a ball valve seat 15' and is received in a closing body cap 12' (FIG. 3*c*) of comparatively small axial design length. A cap bottom 16' of the closing body cap 12' is arched inwards. By pressing the advantageously plastically deformable arching further inwards in axial direction, a closing body stroke of the control valve ball 10" can be reset.

Figure 3A:
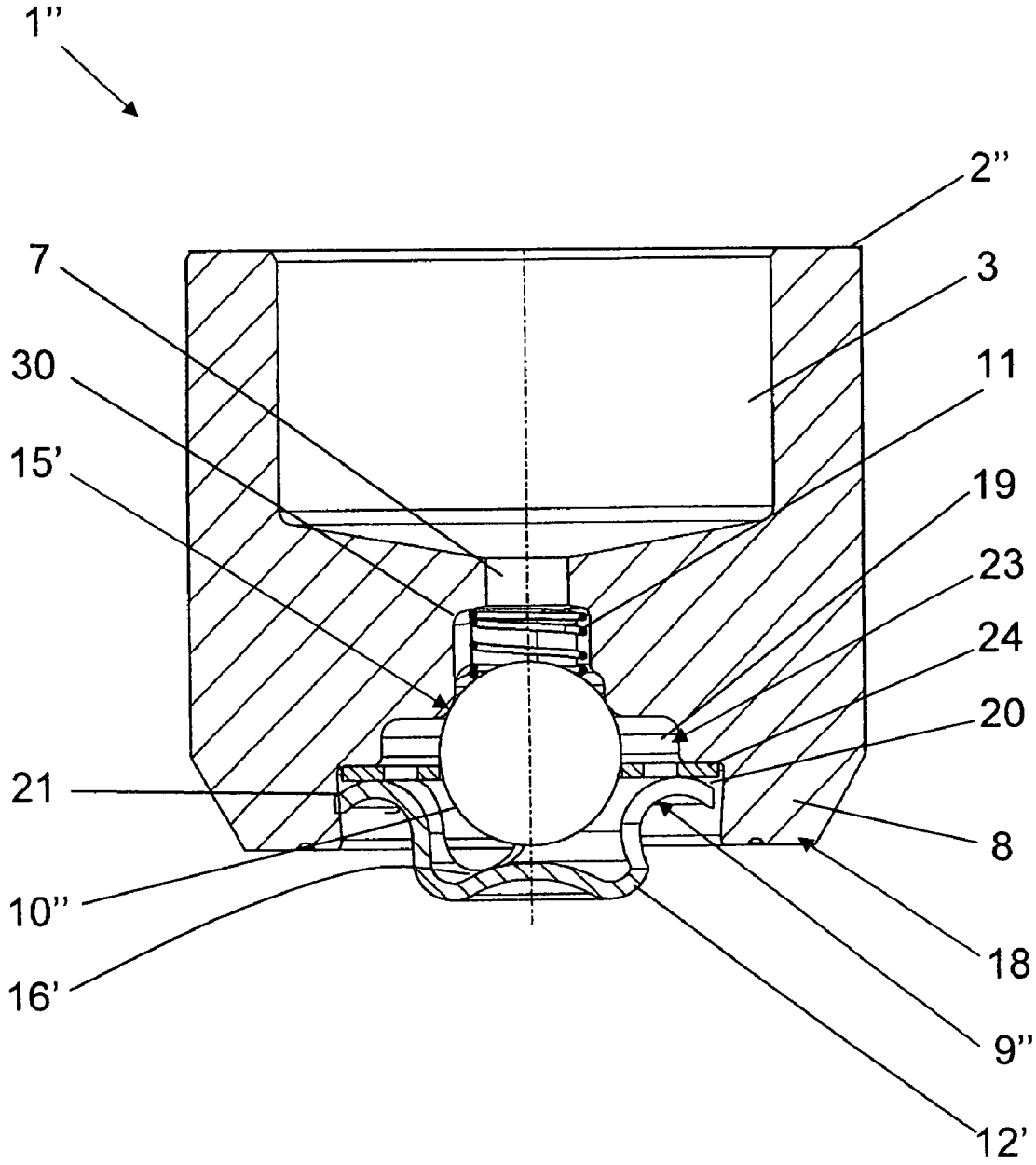
Figure 3B:
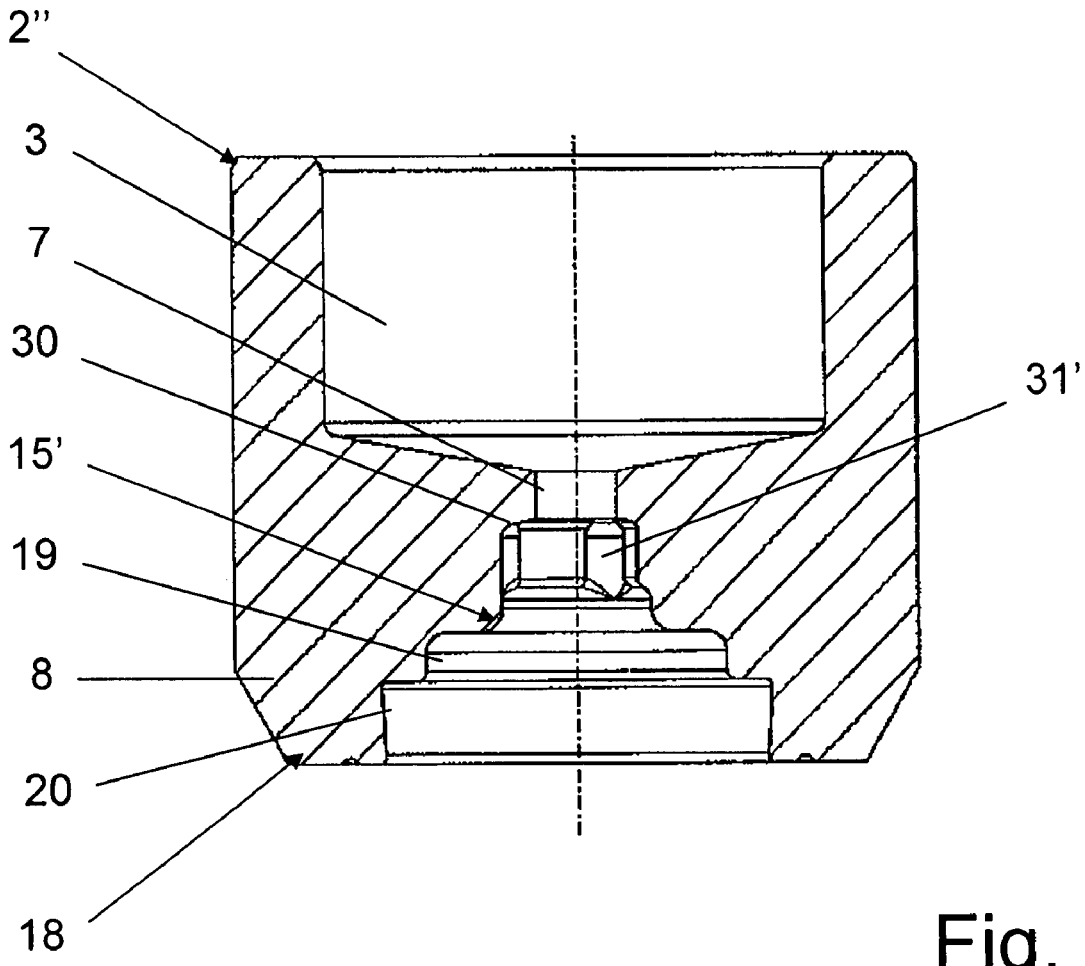
Figure 3C:
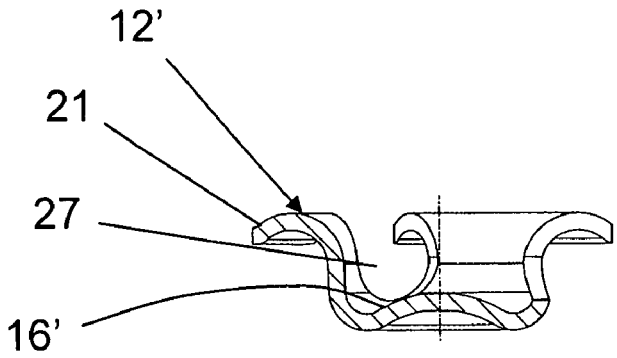

The control valve spring 11 is supported in opening direction between the control valve ball 10" and a stepped widening 30 of the piston bore 7. A lateral protrusion 31' can be additionally configured within the piston bore 7 at the level of the control valve spring 11. The medium pressure chamber 19 of the flow guide device 23 comprises a different remaining free space volume corresponding to the different closing body geometry (FIG. 3, FIG. 3*a*).

Figure 4:
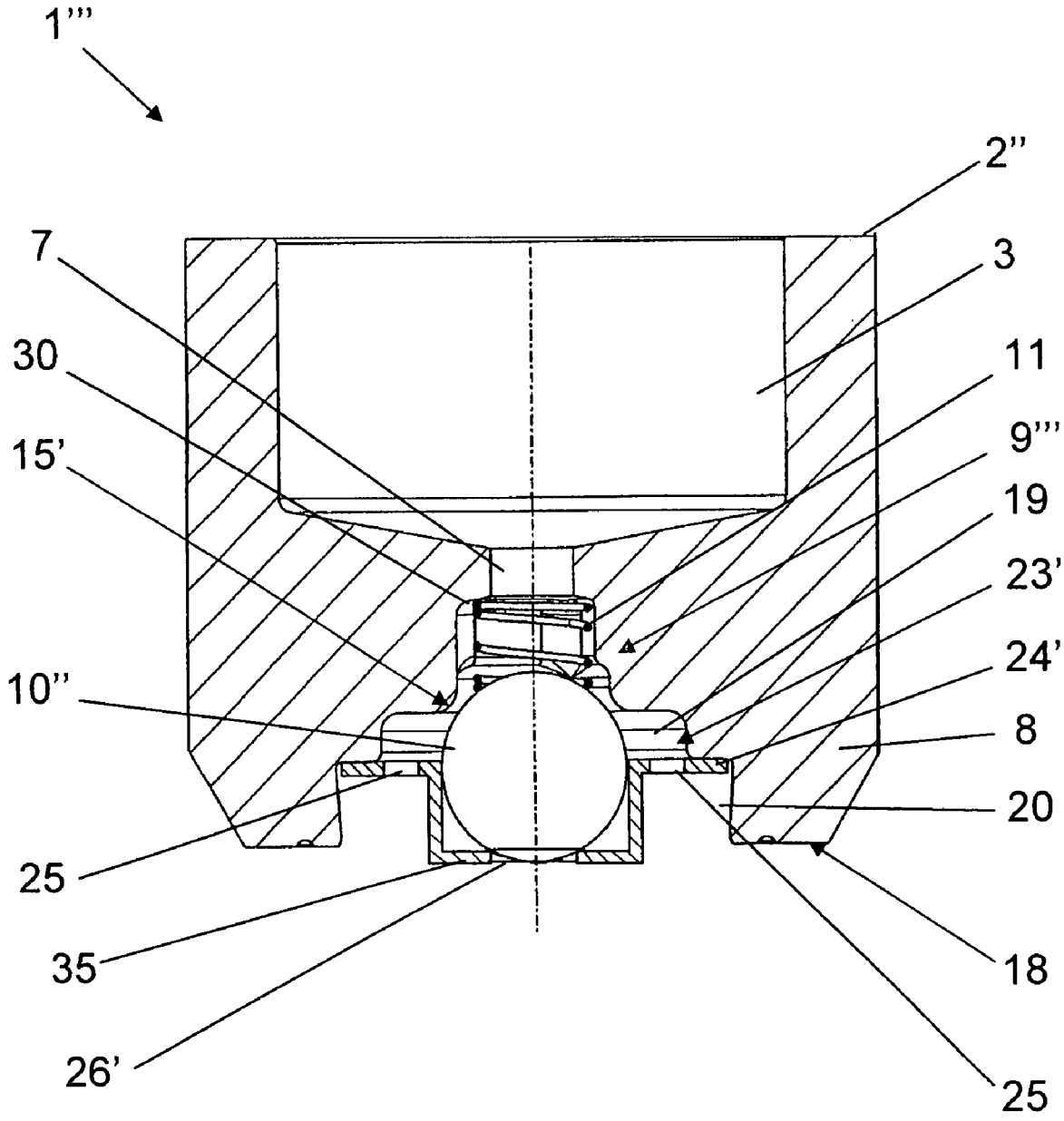

Finally, FIG. 4 shows a fourth form of embodiment with a tappet 1'", a control valve 9'" and a flow control device 23' in which a flow control element 24' has a pot-shaped configuration. The control valve ball 10" is received in the pot 24' so that this assumes the stroke limitation function of the conventional closing body cap. The piston 2' corresponds to the form of embodiment of FIG. 3.

A central bore 26' arranged in a bottom 35 of the pot 24' has a diameter that is smaller than the diameter of the control valve ball 10". Oil transfer is effected through the apertures 25 in the radial portion of the flow control element 24' when the ball 10" is bearing against central bore 26'. When the ball 10" lifts off the central bore 26' upon a hydraulic loading, this central bore 26' is unblocked and made available, in addition to the apertures 25, for the pressure build-up in the medium pressure chamber 19.

The known mode of the functioning of an RSHVA is supplemented with an additional control mechanism, the inventive flow control device 23, 23':

The open position of the valve in which the closing body 10, 10', 10" bears against its stroke limitation corresponds to a camshaft position in the cam base circle of a camshaft rotating in the valve train. Upon a subsequent excursion of a cam lobe, the tappet 1, 1', 1" is compressed, so that a pressure build-up is initiated in the high pressure chamber 5. This results in a hydraulic loading of the closing body 10, 10', 10" that leads to a flow of control oil from the high pressure chamber 5 in the direction of the low pressure chamber 3. Till the resulting hydraulic force on the closing body becomes high enough to overcome the biasing force of the control valve spring 11, so that the closing body 10, 10', 10" lifts off its stroke limitation, that is to say, off the cap bottom 16, 16' or the pot bottom 35, and comes to bear sealingly against the valve seat 15, 15', the tappet 1, 1', 1" produces an idle stroke through its axial collapsing movement, i. e. it compensates its axial loading.

A pressure differential thus produced in closing direction is controlled by the inventive flow control device 23, 23'. Above the flow control element 24, 24', a comparatively medium pressure is at first built up in the medium pressure chamber 19 because the flow control element 24, 24' blocks or weakens a build-up of high pressure like in the rest of the high pressure chamber 5. Due to the apertures 25, the high pressure build-up is retarded because the volume flow or the flow cross-section is reduced compared to an unobstructed oil flow. Accordingly, as a result, the point of time of closing of the control valve 9, 9', 9", 9'" is deferred and the magnitude of the idle stroke is changed. The adjustment or configuration of the apertures 25, if need be, adapted to further parameters like closing body stroke 17, biasing force of the control valve spring 11 and configuration of the recesses 27 in the closing body cap 12, 12', thus enables a setting of a desired idle stroke.

The invention claimed is:

1. A hydraulic valve lash adjuster with idle stroke function for a valve train of an internal combustion engine, said hydraulic valve lash adjuster comprising a piston that is guided for displacement in a piston housing and elastically supported against said housing, said piston comprising a low pressure chamber that communicates via an axial opening in a piston bottom with a high pressure chamber defined by the piston housing and the piston, and further comprising a control valve acting between said pressure chambers, said control valve comprising a valve closing body that can be brought to bear sealingly against a valve seat that surrounds the axial opening on a piston body undersurface and is received in an element that limits a closing body stroke, and said control valve further comprising a control valve spring that loads the valve closing body in opening direction, and an idle stroke being produced during an axial collapsing movement between the piston and the piston housing during which said valve closing body is hydraulically loaded in closing direction against the action of the control valve spring by a pressure build-up in the high pressure chamber, wherein a retarded pressure build-up can be obtained through a flow control device arranged on a high pressure chamber-side and comprising a flow control element configured as a disk and a medium pressure chamber that extends between the flow control element and the axial opening.

2. A hydraulic valve lash adjuster of claim 1, wherein the medium pressure chamber is arranged in a stepped recess on the piston bottom undersurface of the piston bottom.

3. A hydraulic valve lash adjuster of claim 1, wherein the flow control element is fixed on the piston bottom undersurface.

4. A hydraulic valve lash adjuster of claim 1, wherein the flow control disk is fixed on the piston bottom undersurface by a cap flange of a closing body cap in which the valve closing body is received.

5. A hydraulic valve lash adjuster of claim 1, wherein, for adjusting the retarded pressure build-up, the flow control element comprises at least one aperture.

6. A hydraulic valve adjuster of claim 5, wherein at least one aperture is configured as bores.

7. A hydraulic valve adjuster of claim 5, wherein at least one aperture comprises disk-spring-type flaps.

8. A hydraulic valve adjuster of claim 5, wherein at least one aperture comprises latch-type flaps.

9. A hydraulic valve lash adjuster of claim 5, wherein the pressure build-up can be adjusted by a positioning of the at least one aperture of the flow control element relative to one or more recesses of the closing body cap.

10. A hydraulic valve lash adjuster of claim 1, wherein the flow control disk comprises a central bore in which the valve closing body is guided with a guiding clearance.

11. A hydraulic valve lash adjuster of claim 1, wherein the valve closing body is configured as a needle-shaped sealing piston acting through a plate-shaped sealing surface.

12. A hydraulic valve lash adjuster of claim 11, wherein the control valve spring is arranged partially submerged in a central recess of the sealing piston, coaxially to the axial opening and supported between an edge of the axial opening and a bottom of the recess.

13. A hydraulic valve lash adjuster of claim 11, wherein approximately one half of a length of the control valve spring is submerged in a central recess of the sealing piston and another half of the length is submerged in a widening of the axial opening, and the control valve spring is supported between an edge of the widening of the axial opening and a bottom of the recess.

14. A hydraulic valve lash adjuster of claim 1, wherein the valve closing body is configured as a ball.

15. A hydraulic valve lash adjuster of claim 1, wherein the flow control element is configured as a pot comprising apertures, said pot receives the valve control body and acts, at the same time, as a stroke limitation of the valve closing body.

16. A hydraulic valve lash adjuster of claim 15, wherein the flow control pot comprises a central bore whose diameter is smaller than a diameter of the valve closing body.

17. A hydraulic valve lash adjuster of claim 1, wherein a configuration of the aperture or apertures of the flow control element and/or a spring force of the control valve spring and/or the closing body stroke of the valve closing body are matched to one another.

18. A hydraulic valve lash adjuster of claim 1, wherein the flow control element is made of any solid material.

* * * * *